US009261009B2

(12) United States Patent
Hamashima et al.

(10) Patent No.: US 9,261,009 B2
(45) Date of Patent: Feb. 16, 2016

(54) AUTOMOTIVE MUFFLER

(71) Applicant: HONDA MOTOR CO., LTD., Minato-Ku, Tokyo (JP)

(72) Inventors: Hidenori Hamashima, Wako (JP); Satoshi Watanabe, Wako (JP); Hidenori Suzuki, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 14/317,535

(22) Filed: Jun. 27, 2014

(65) Prior Publication Data

US 2015/0008068 A1 Jan. 8, 2015

(30) Foreign Application Priority Data

Jul. 3, 2013 (JP) ..... 2013-139866
Jul. 3, 2013 (JP) ..... 2013-139869

(51) Int. Cl.
*F01N 13/08* (2010.01)
*F01N 13/18* (2010.01)
*F01N 1/08* (2006.01)

(52) U.S. Cl.
CPC ..... *F01N 13/1888* (2013.01); *F01N 1/083* (2013.01); *F01N 1/084* (2013.01); *Y10T 29/49398* (2015.01)

(58) Field of Classification Search
CPC ..... F01N 13/1888; F01N 1/083; F01N 1/084; Y10T 29/49398
USPC ..... 181/264, 268, 282
See application file for complete search history.

(56) References Cited

U.S. PATENT DOCUMENTS 2,484,827 A * 10/1949 Harley ..... 181/268
3,650,354 A * 3/1972 Gordon ..... 181/240
4,111,278 A 9/1978 Bergman
4,332,307 A * 6/1982 Ito ..... 181/256

(Continued)

FOREIGN PATENT DOCUMENTS

DE 102009056815 A1 6/2010
JP S5544077 U 3/1980

(Continued)

OTHER PUBLICATIONS

Office Action issued on Mar. 31, 2015 in the corresponding Japanese Patent Application No. 2013-139866.

(Continued)

*Primary Examiner* — Jeremy Luks
(74) *Attorney, Agent, or Firm* — Carrier Blackman & Associates, P.C.; Joseph P. Carrier; Jeffrey T. Gedeon

(57) ABSTRACT

In a muffler comprising a shell formed by joining a pair of shell halves each including a bottom wall and a side wall and defining an opening opposite to the bottom wall, the shell halves being joined to each other at the openings thereof, the muffler further comprising an inlet pipe for introducing exhaust gas into the shell and an outlet pipe for expelling exhaust gas from inside the shell, a depth of one of the shell halves is greater than a depth of the other shell half, and the inlet pipe and the outlet pipe are connected to the side wall of the one shell half so that the overall plane stiffness of the shell is well balanced and maximized. Therefore, without adding any reinforcement or increasing the wall thickness of the shell, the acoustic emission from the muffler can be minimized.

16 Claims, 14 Drawing Sheets

(56) References Cited

U.S. PATENT DOCUMENTS

| | | | | |
|---|---|---|---|---|
| 5,229,557 | A * | 7/1993 | Allman et al. | 181/282 |
| 5,332,873 | A * | 7/1994 | Kullander et al. | 181/243 |
| 5,545,860 | A * | 8/1996 | Wilkes et al. | 181/255 |
| 6,170,604 | B1 * | 1/2001 | Menzel et al. | 181/230 |
| 6,257,367 | B1 * | 7/2001 | Allman | 181/282 |
| 7,712,578 | B2 * | 5/2010 | Han | 181/272 |
| 8,678,132 | B2 * | 3/2014 | Bischel et al. | 181/228 |
| 2004/0003963 | A1 * | 1/2004 | Worner et al. | 181/239 |
| 2005/0155818 | A1 * | 7/2005 | Wirtz | 181/269 |
| 2006/0081416 | A1 * | 4/2006 | Nentrup | 181/256 |
| 2008/0053076 | A1 * | 3/2008 | Kellermann et al. | 60/299 |
| 2012/0325578 | A1 * | 12/2012 | Giaume | 181/282 |

FOREIGN PATENT DOCUMENTS

| | | | |
|---|---|---|---|
| JP | S5544078 | U | 3/1980 |
| JP | S5552506 | U | 4/1980 |
| JP | H0552211 | U | 7/1993 |
| JP | -108260937 | A | 10/1996 |
| JP | 2001342825 | A | 12/2001 |
| JP | 2004156474 | A | 6/2004 |
| JP | 2004-245052 | A | 9/2004 |
| JP | 2005153015 | A | 6/2005 |
| JP | 2005315168 | A | 11/2005 |
| JP | 2006189007 | A | 7/2006 |
| JP | 2007162537 | A | 6/2007 |
| JP | 2014200806 | A | 10/2014 |

OTHER PUBLICATIONS

Office Action issued on Mar. 31, 2015 in the corresponding Japanese Patent Application No. 2013-139869.

Final Office Action issued on Nov. 10, 2015 in corresponding Japanese Patent Application No. 2013-139866.

Final Office Action issued on Nov. 10, 2015 in corresponding Japanese Patent Application No. 2013-139869.

* cited by examiner

AUTOMOTIVE MUFFLER

TECHNICAL FIELD

The present invention relates to a muffler forming a part of an exhaust system of an internal combustion engine of a motor vehicle.

PRIOR ART

A motor vehicle powered by an internal combustion engine is provided with an exhaust system which includes an exhaust manifold, a catalyst device, an exhaust pipe and a muffler for the purposes of removing noxious substances from the exhaust gas and reducing exhaust noises. The muffler typically consists of a shell made of steel plate, a plurality of separators that separate the interior of the shell into a number compartments (such as an expansion chamber and a resonance chamber), an inlet pipe for introducing exhaust gas into the shell and an outlet pipe extending rearward from the shell to expel the exhaust gas. These components are usually joined together by welding such as laser welding. See JP2004-245052A, for instance. The expansion chamber attenuates the pulsating pressure changes of the exhaust gas, and the resonance chamber attenuates a prescribed frequency component (such as 80 to 200 Hz) which is relatively annoying to vehicle occupants from the exhaust noises.

The shell of a muffler is typically cylindrical in shape, and the cross section may be either round or elliptic. To maximize the effectiveness of a muffler, a large internal volume is desirable. However, in modern motor vehicles, the floor panel is generally planar in shape, and allows a relatively limited space thereunder. Therefore, cylindrical mufflers require such large vertical dimensions that they are being taken over by mufflers of more lower profile configurations. Low profile mufflers are advantageous for use in modern vehicle body designs, but have the disadvantage of lacking in plane stiffness. A lack in plane stiffness means an increase in an undesired acoustic emission from the muffler owing to the vibrations of the shell wall of the muffler.

In the muffler disclosed in JP2004-245052A, a relatively flat large wall area is corrugated for the purpose of increasing the stiffness thereof, and two shell halves each provided with a bottom wall and a side wall defining an opening opposite to the bottom wall are joined to each other at the openings thereof. The two shell halves are provided with a same depth, and the inlet pipe and the outlet pipe are connected to the shell by being interposed between the upper and lower shell halves.

According to this prior art, each shell half is provided with a relatively large depth so that the side wall may not have an adequate stiffness, and may cause an undesired acoustic emission therefrom.

When the shell of the muffler is cylindrical in shape, a plurality of chambers can be defined therein without much difficulty simply by press fitting circular or elliptic separator plates in the shell and attaching circular or elliptic ends plates at either end of the shell.

However, when the shell is formed by a pair of shallow upper and lower shell halves, separator plates may not be press fitted into the shell, and certain welding or bonding arrangements are required to fixedly place the separator plates within the shell. As the separator plates are required to be connected to the inner side of the shell wall in an air tight manner, there is a considerable difficulty in holding the edges of the separator plates in close contact with the inner side of the shell wall while the separator plates are welded to the shell wall.

SUMMARY OF THE INVENTION

In view of such problems of the prior art, a primary object of the present invention is to provide an automotive muffler which is formed by a shallow shell, but has a high plane stiffness for the given thickness of the shell wall.

A second object of the present invention is to provide an automotive muffler which is formed by a shallow shell, but is effective in minimizing exhaust noises owing to an increased plane stiffness of the shell wall.

A third object of the present invention is to provide an automotive muffler which is formed by a shallow shell, but allows separators to be connected to the shell wall in a favorable manner.

Such objects of the present invention can be accomplished by providing a muffler, comprising a shell formed by joining a pair of shell halves each defining a vessel shape including a bottom wall and a side wall and defining an opening opposite to the bottom wall, the shell halves being joined to each other at the openings thereof, the muffler further comprising an inlet pipe for introducing exhaust gas into the shell and an outlet pipe for expelling exhaust gas from inside the shell, wherein: a depth of one of the shell halves as measured between the bottom wall and the opening is greater than a depth of the other shell half, and the inlet pipe and the outlet pipe are connected to the side wall of the one shell half.

According to this arrangement, because the shell half having a greater depth or a higher side wall is in effect reinforced by the inlet pipe and the outlet pipe are connected thereto, the plane stiffness of the one shell half is well balanced to that of the other shell half, and the overall stiffness of the shell is increased. Therefore, without adding any reinforcement or increasing the wall thickness of the shell, the acoustic emission from the muffler which can be caused by the vibration of the shell wall of the muffler can be minimized.

In a muffler, moisture inevitably condenses in the bottom part of the shell. If the, one shell half is located below the other shell half, the outlet pipe is placed adjacent to the bottom of the shell so that the expulsion of condensed moisture from the muffler is favorably promoted.

According to a preferred embodiment of the present invention, the opening of each shell half is defined by an annular fringe extending along a free end of the side wall thereof, and the annular fringes of the two shell halves are welded to each other in an overlapping relationship.

Thereby, the two shell halves can be favorably welded to each other without requiring any protruding features or increasing the size of the shell. The overlapping part of the annular fringes in effect increases the thickness of the shell wall, and this increases the stiffness of the side part of the shell, thereby minimizing acoustic emission from the muffler.

Preferably, one of the annular fringes is provided with a slightly smaller circumferential length than that of the other annular fringe so that the one annular fringe is press fitted into the other annular fringe and welded thereto in an overlapping relationship.

Thereby, one of the annular fringes can be press fitted into the other annular fringe so that the two parts can be favorably welded to each other in a highly air tight manner.

The muffler may further comprise a separator attached to the two shell halves and separating an inner chamber of the shell, the two annular fringes being spaced from an opposing edge of the separator.

Thereby, the two annular fringes are not interfered by the edge of the separator so that the two annular fringes can be press fitted into each other in an accurate manner.

According to a particularly preferred embodiment of the present invention, the separator is provided with an upper flange and a lower flange extending substantially perpendicularly to a major plane of the separator from an upper edge and a lower edge thereof, respectively, and each flange is welded to an opposing wall of the corresponding shell half while being placed in a pre-stressed condition.

By placing the upper and lower flanges in a pre-stressed condition, the flanges are caused to be urged against the opposing walls of the corresponding shell halves so that the two parts are welded in a favorable manner. Alternatively or additionally, each flange may be welded to an opposing wall of the corresponding shell half while being placed in close contact with the opposing wall of the corresponding shell half. In particular, the flanges that are firmly connected to the upper and lower shell halves significantly contribute to the increased stiffness of the shell.

To provide a surface complementary to each of the upper and lower flanges, the opposing wall of each shell half is defined by a planar bottom wall of a narrow recess recessed as seen from inside the shell and extending along the corresponding edge of the separator. Such a narrow recess provides the functions of correctly positioning the separator in the shell, and increasing the stiffness of the shell. A particularly favorable result in these respects can be achieved if the narrow recess is formed as an annular recess extending substantially along the entire length of the edge of the separator or the entire circumference of the shell.

In order to achieve a close contact between the upper and lower flanges and the opposing wall of the shell, it is preferred that the shell is provided with a planar section which is engaged by each of the upper and lower flanges, and the upper flange and the lower flange are welded to the corresponding planar section while being held in parallel with the corresponding planar sections.

According to a particularly preferred embodiment of the present invention, each flange is initially bent by an angle slightly smaller than 90 degrees with respect to a major plane of the separator, and is forced to an angle of about 90 degrees with respect to the major plane of the separator against a resilient restoring force created therein and placed in a pre-stressed condition when the flange is welded to the opposing wall surface of the corresponding shell half.

According to a preferred embodiment of the present invention, the separator is provided with an arcuate edge in an upper part and a lower part thereof, and the upper and the lower flanges are formed along the upper and lower arcuate edges of the separator.

The arcuate edge is desirably provided with a constant radius of curvature so that the stamping of the shell halves and the separator may be carried out in a highly precise manner so that a close contact between the upper and lower flanges and the opposing walls of the shell halves may be achieved.

The separator may be further provided with a pair of side flanges extending substantially perpendicularly to a major plane of the separator from lateral edges thereof, the upper and lower flanges being provided with a greater width than either of the side flanges.

These side edges increase the stiffness of the separator. When each side flange is detached from an opposing wall of the corresponding shell half, the upper and lower flanges are given with a freedom in deforming in conformity with the opposing wall of the shell so that the separator can be installed in the shell in a mechanically stable manner without causing any undue stress in the welded part thereof.

The present invention further provides a method for manufacturing a muffler, comprising the steps of: preparing a pair of shell halves, each defining a vessel shape including a bottom wall and a side wall and defining an opening opposite to the bottom wall; installing a separator into one of the shell halves; connecting an inlet pipe for introducing exhaust gas into the muffler to the side wall of one of the shell halves; connecting an outlet pipe for expelling exhaust gas from the muffler to the side wall of the other shell half; and joining the two shell halves to each other by welding the two halves at the openings thereof and thereby forming a substantially enclosed shell; wherein the separator is provided with at least one of an upper flange and a lower flange extending substantially perpendicularly to a major plane of the separator, and the flange is placed in a pre-stressed condition when the flange is welded to the opposing wall surface of the corresponding shell half.

BRIEF DESCRIPTION OF THE DRAWINGS

Now the present invention is described in the following with reference to the appended drawings, in which.

DESCRIPTION OF THE PREFERRED EMBODIMENT(S)

An automotive muffler 1 embodying the present invention is described in the following with reference to the appended drawings. In some of the drawings, various directions are indicated in an upper left corner for the convenience of description.

Figure 1:
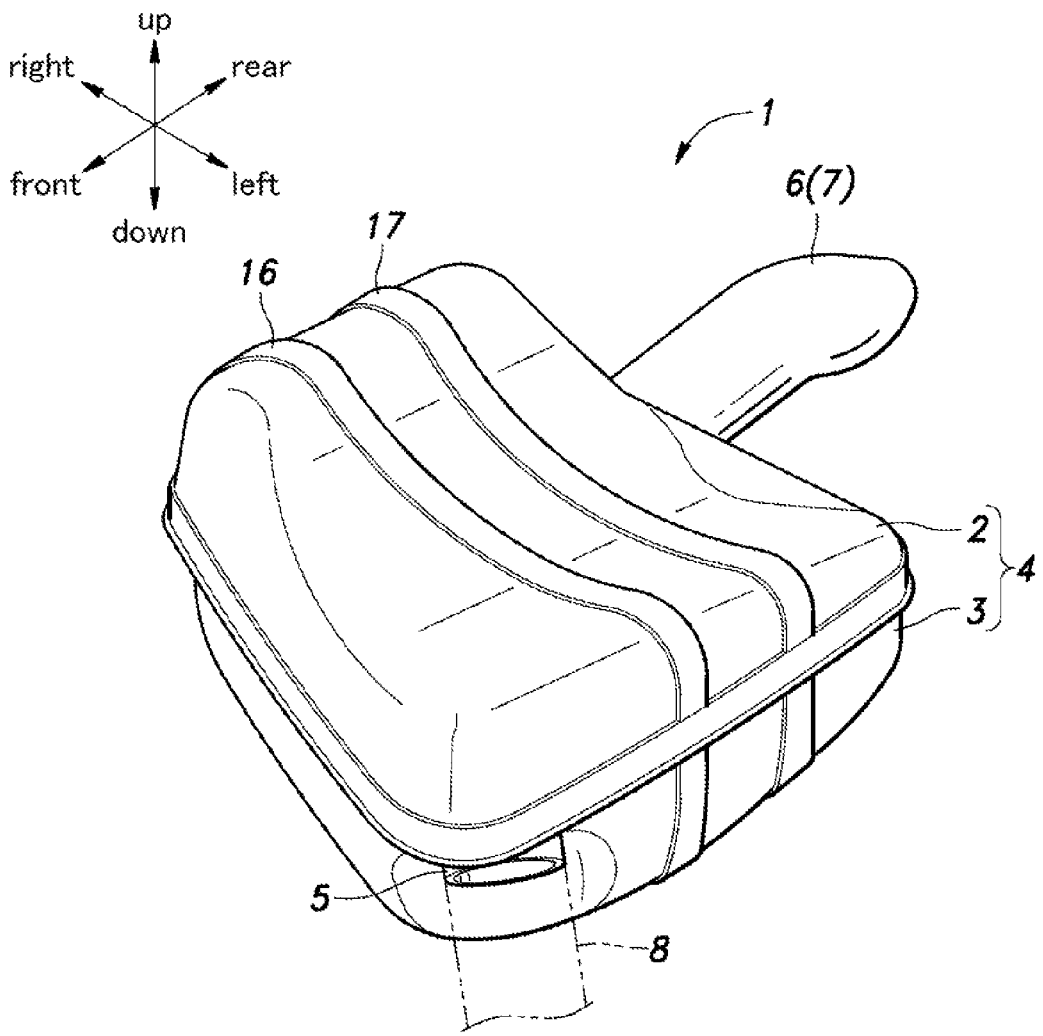
FIG. 1 is a perspective view of a muffler embodying the present invention.
Figure 2:
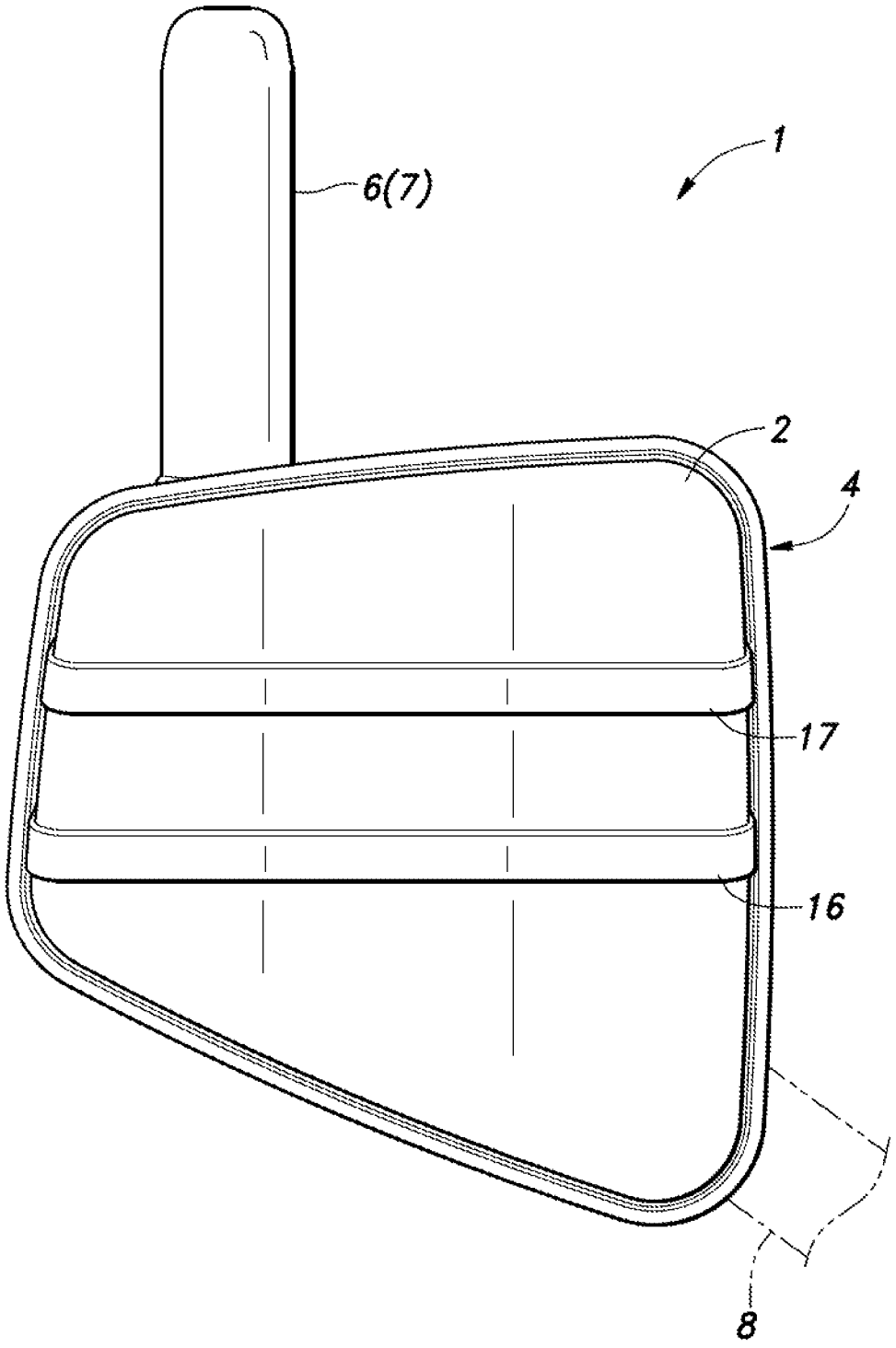
FIG. 2 is a plan view of the muffler.
Figure 3:
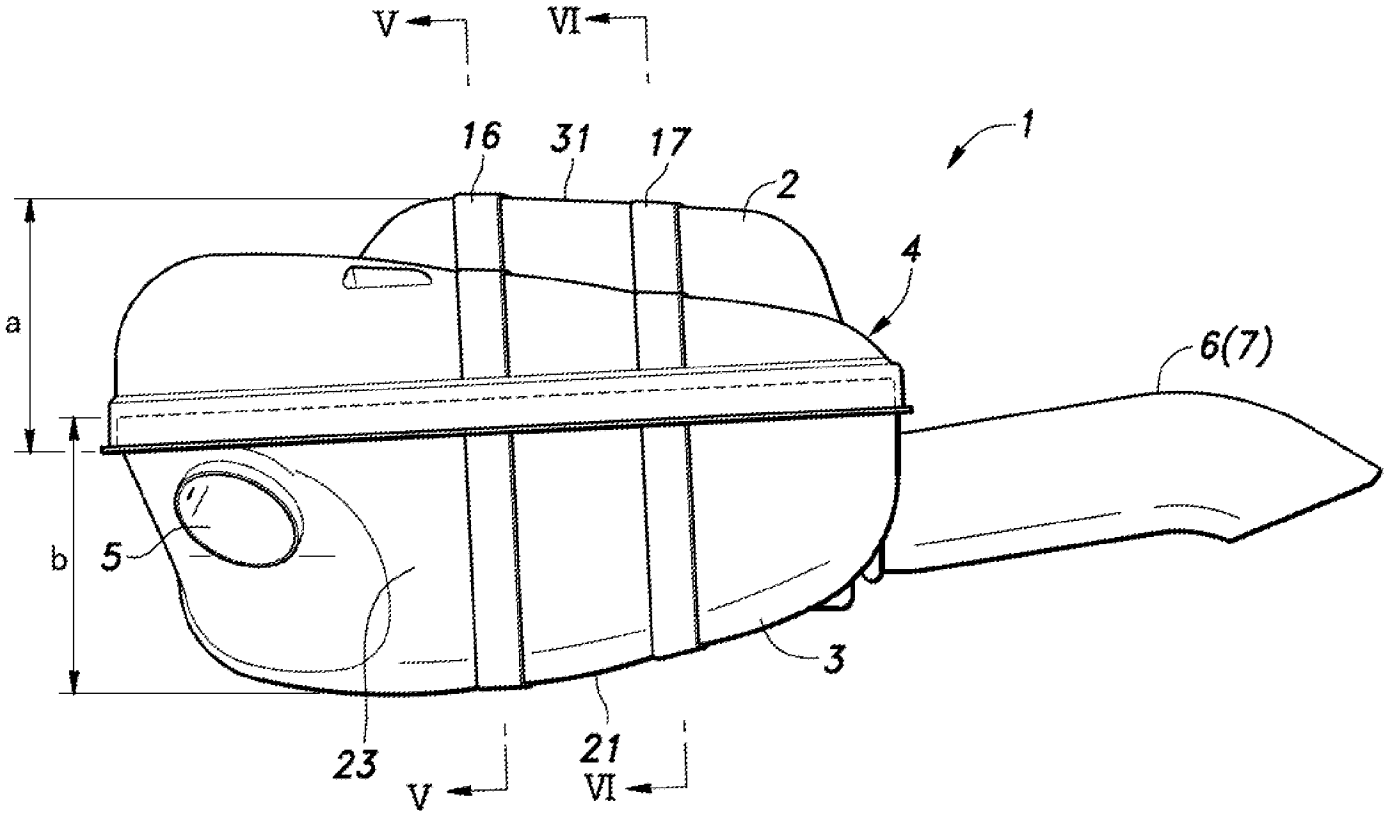
FIG. 3 is a side view of the muffler.

Referring to FIGS. 1 to 3, the muffler 1 comprises a shell 4 consisting of an upper shell half 2 and a lower shell half 3 each formed by stamping steel plate and being joined with each other, an inlet pipe 5 extending obliquely forward from a front left end of the lower shell half 3, and an outlet pipe 7 extending rearward from a rear right end of the lower shell half 3. The rear end of the outlet pipe 7 is formed as a tail pipe 6. As the tail pipe 6 can be considered as a part of the outlet pipe 7 for practical purposes, the tail pipe 6 is treated as a part of the outlet pipe 7 in the following description whenever appropriate. The muffler 1 is resiliently suspended from the lower surface of the vehicle body of a four-wheel passenger vehicle via a bracket not shown in the drawings in a per se known manner. The upstream end of the inlet pipe 5 is connected to an exhaust pipe 8 passed under the floor panel of the vehicle body so that the exhaust gas expelled from an internal combustion engine not shown in the drawings is introduced into the muffler 1 via an exhaust manifold, a catalyst device and the exhaust pipe 8.

Figure 4:
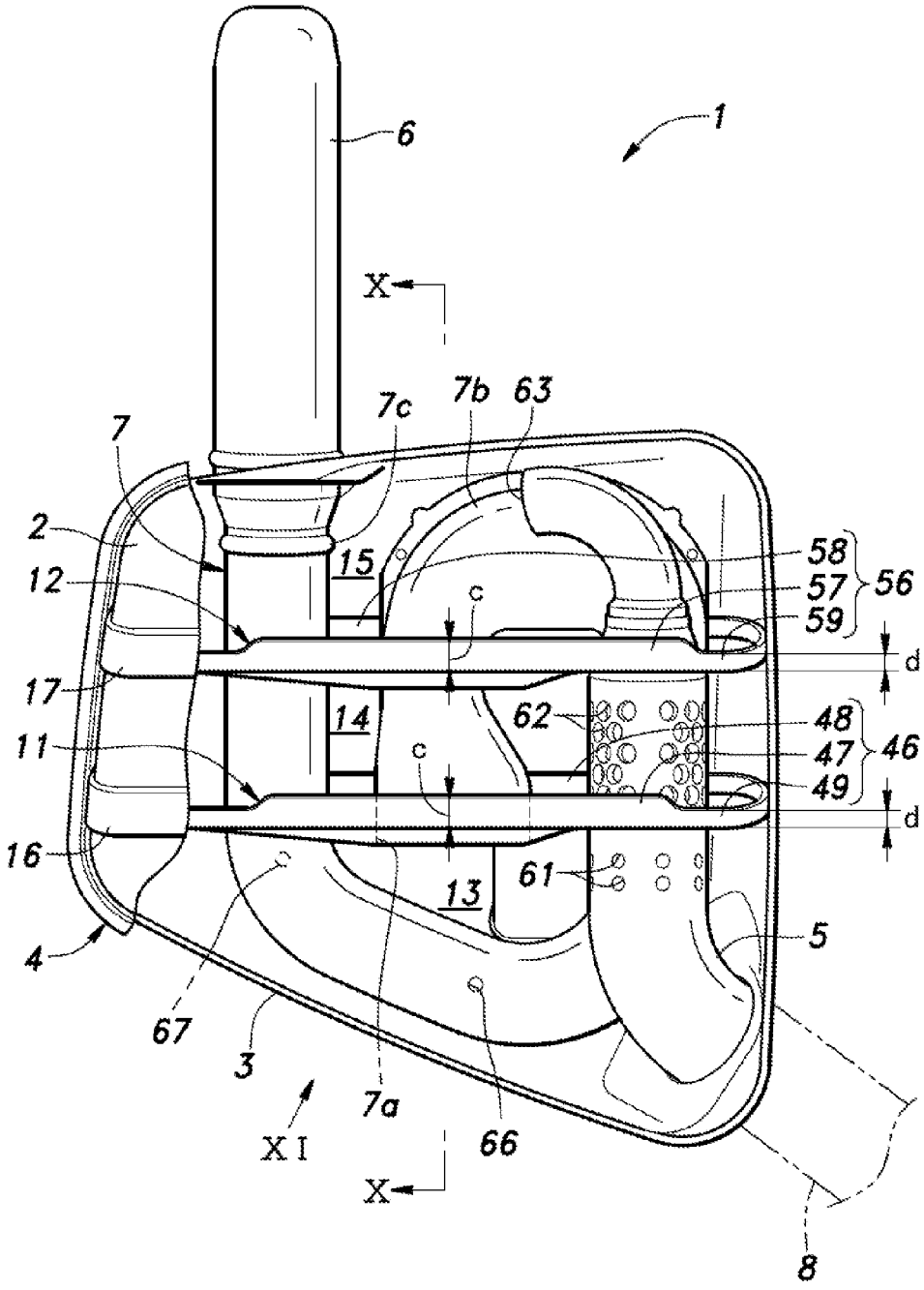
FIG. 4 is a partly broken away plan view of the muffler.

As shown in FIG. 4, a first separator 11 and a second separators 12 each formed by stamping steel plate are placed in the shell 4 one behind the other. The first and second separators 11 and 12 extend perpendicularly to the fore and aft direction in a mutually parallel relationship so that a first expansion chamber 12, a second expansion chamber 14 and a resonance chamber 15 are defined within the shell 4 from the front to the rear in that order. The part of the inlet pipe 5 located within the shell 4 extends in a substantially horizontal plane, and the part of the outlet pipe 7 located within the shell 4 extends in a substantially horizontal plane which is located below the horizontal plane of the inlet pipe 5.

The parts of the shell 4 at which the first and second separators 11 and 12 abut from inside the shell 4 are each formed as an annular narrow recess defining a flat bottom surface (as seen from inside the shell 4) and surrounding the entire circumference of the shell 4. The "flat" as used herein means that the bottom surface of the narrow recess is linear in the fore and aft direction or in the direction perpendicular to a major place of each separator 11, 12. As can be readily appreciated, the bottom surface of the narrow recess is curved in the circumferential direction along the curved outer contour of the shell 4. These annular narrow recesses are referred to as a first bonding portion 16 and a second bonding portion 17 in the following description. The first and second separators 11 and 12 are fixedly secured in the shell 4 with the edges thereof engaged by the flat bottom surfaces of the first bonding portion 16 and the second bonding portion 17, respectively, as will be described hereinafter.

Figure 5:
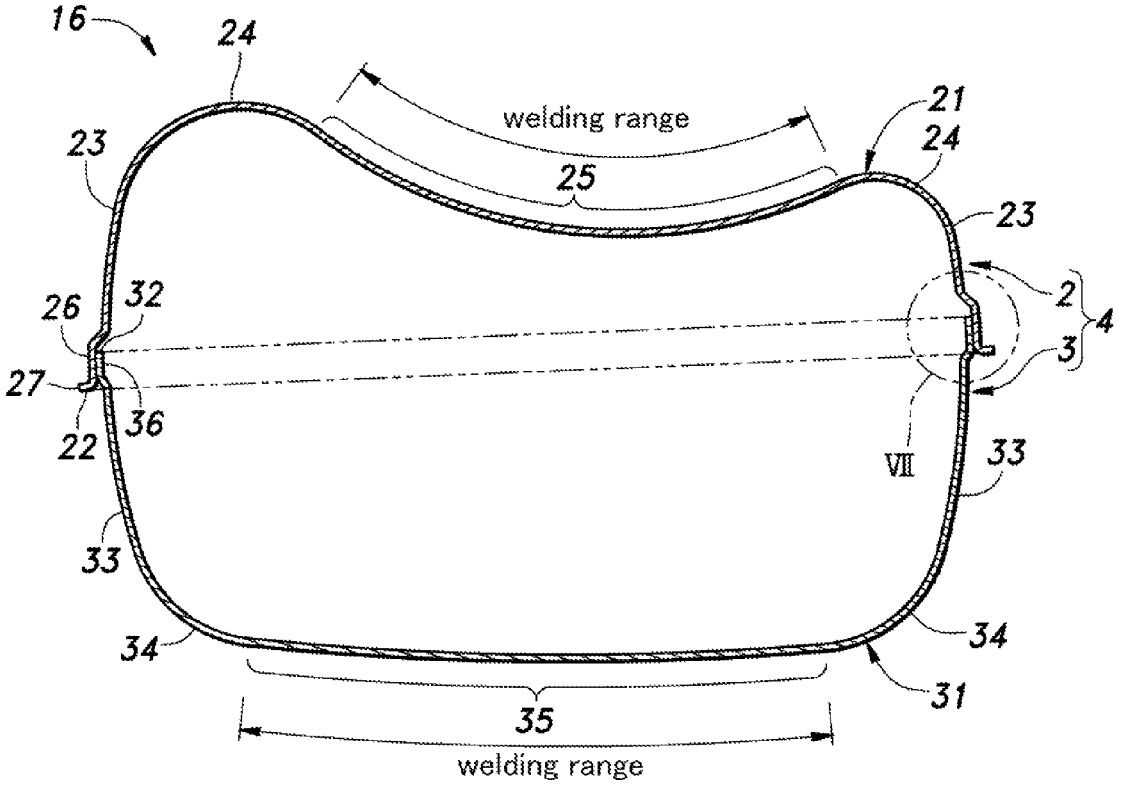
FIG. 5 is a sectional view taken along line V-V of FIG. 3.
Figure 6:
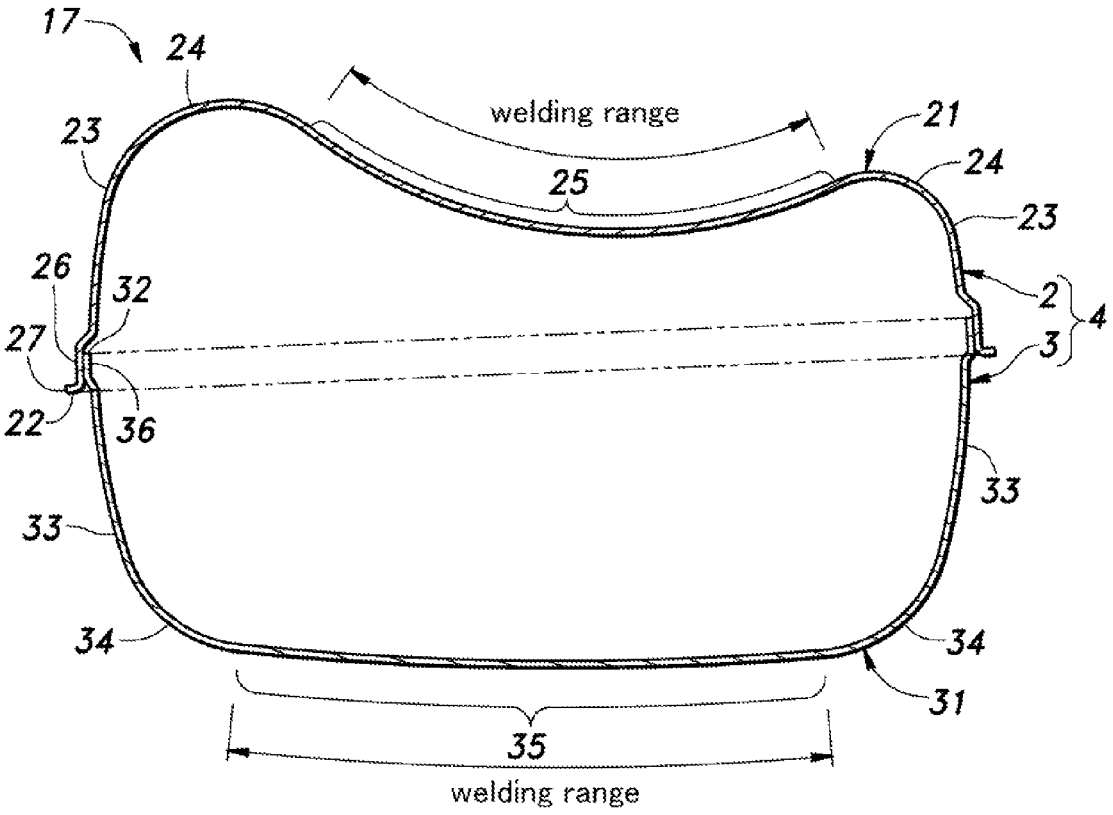
FIG. 6 is a sectional view taken along line VI-VI of FIG. 3.

As shown in FIGS. 5 and 6, the upper shell half 2 is provided with the shape of a vessel including a relatively flat bottom wall 21 and an annular side wall 23 defining an opening 22 opposite to the bottom wall 21, with the opening 22 facing downward in the assembled state. As seen in lateral cross sections as shown in FIGS. 5 and 6, the two side walls 23 extend vertically from the opening 22, and the bottom wall 21 includes a pair of first curved portions 24 continuing from the respective side walls 21 and defining mutually similar upwardly convex curves and a second curved portion 25 extending between the two first curved portions 24 and defining an downwardly concave curve. In the illustrated embodiment, a large part of the second curved portion 25 is defined by a single arc of a certain radius of curvature which is substantially greater than those of the first curved portions 24. These three curved portions 24 and 25 define a smooth continuation of the two side walls 23.

The lower shell halve 3 is also provided with the shape of a vessel including a relatively flat bottom wall 31 and an annular side wall 33 defining an opening 32 opposite to the bottom wall 31, with the opening 32 facing upward in the assembled state. The two shell halves 2 and 3 are joined to each other by fitting the opening 21 of the lower shell half 2 into the opening 22 of the upper shell half 2, and welding the overlapping parts of the openings 22 and 32 of the upper and lower halves 2 and 3. This muffler 1 is mounted to the vehicle such that the mating parts of the two shell halves 2 and 3 extend in a horizontal plane. In this mounted condition, the bottom wall 31 of the lower shell half 3 is slightly slanted downward toward the front (or toward the expansion chamber 13.

As seen in lateral cross sections as shown in FIGS. 5 and 6, the two side walls 33 of the lower shell half 3 extend vertically from the opening 33, and the bottom wall 31 includes a pair of first curved portions 34 continuing from the respective side walls 31 and defining mutually similar downwardly convex curves and a second curved portion 35 extending between the two first curved portions 34 and defining a slight downwardly convex curve. In the illustrated embodiment, a large part of the second curved portion 35 is defined by a single arc of a certain radius of curvature which is substantially greater than those of the first curved portions 34. These three curved portions 34 and 35 define a smooth continuation of the two side walls 33.

As shown in FIG. 3, the depth b of the lower shell half 3 (the maximum dimension between the opening 32 and the bottom wall 31) is greater than the depth a of the upper shell half 2 (the maximum dimension between the opening 22 and the bottom wall 21). These measurements should be made with regard to the effective parts of the two shell halves 2 and 3, excluding any localized projections if there are any such projections. Therefore, the height of the side wall 33 of the lower shell half 3 is greater than the height of the side wall 23 of the upper shell half 2 as shown in FIGS. 5 and 6. When the shapes of the upper and lower shells happen to be highly irregular, it may be advantageous to form the inner volume of the lower shell half to be greater than that of the upper shell half. In the illustrated embodiment, the bottom wall 31 of the lower shell half 3 is slanted downward toward the front so that the side wall 33 of the lower shell half 3 is lower in the rear than in the front. The inlet pipe 5 is connected to a relatively tall part of the side wall 33. The outlet pipe 7 is located at a substantially same elevation as the inlet pipe 5, but is connected to a relatively short part of the side wall 33 of the lower shell half 3.

Figure 7:
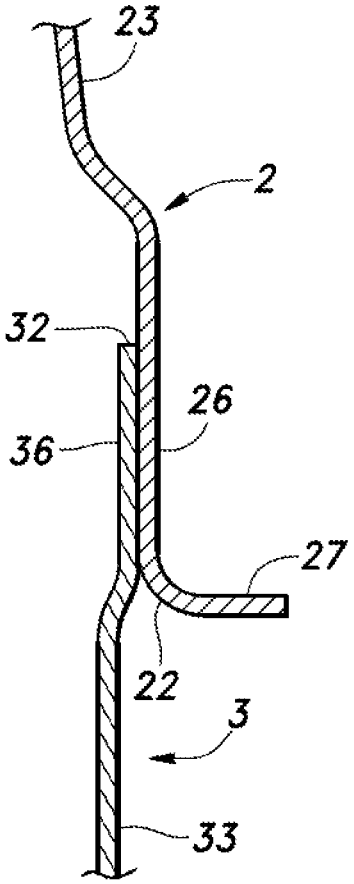
FIG. 7 is an enlarged fragmentary sectional view of a part VII of FIG. 5.

The part of the side wall 23 of the upper shell half 2 defining the opening 22 is formed with an annular engagement fringe 26 which is laterally outwardly offset from the remaining part of the side wall 23 defining a planar band as shown in FIG. 7. The part of the side wall 33 of the lower shell half 3 defining the opening 32 is formed with a similar annular engagement fringe 36. These engagement fringes 26 and 36 are detached from or stay clear from the opposing edges of the first and second separators 11 and 12 although a slight contact between the engagement fringes 26 and 36 and the opposing edges of the first and second separators 11 and 12 is well within the scope and spirit of the present invention. These engagement fringes 26 and 36 are configured and dimensioned such that the annular engagement fringe 36 of the lower shell half 3 closely fits into the annular engagement fringe 26 of the upper shell half 2 in a relatively tight fit. The mutually overlapping parts of the engagement fringes 26 and 36 are laser welded at a vertically middle part thereof over the entire circumference.

In the illustrated embodiment, the peripheral length of the engagement fringe 36 of the lower shell half 3 on the inside is slightly longer (2 mm, for instance) than that of the engagement fringe 26 of the upper shell half 2 on the outside. Therefore, there is an offset given by "difference in the peripheral length/$\pi \cong 0.3$ mm" is created between the two engagement fringes 26 and 36. At the time assembly, the engagement fringe 36 of the lower shell half 3 is press fitted into the engagement fringe 26 of the upper shell half 2 so that the two engagement fringes 26 and 36 are in intimate contact with each other. The free end of the engagement fringe 26 of the upper shell half 2 is provided with an external flare or a guide portion 17 for favorably guiding the engagement fringe 36 of the lower shell half 3 into the engagement fringe 26 of the upper shell half 2.

As the two engagement fringes 26 and 36 are brought into a mutually overlapping condition before being welded to each other, the two shell halves 2 and 3 can be favorably welded together without requiring any bulky flange or other features to be formed or increasing the side of the shell 4. Furthermore, the mutually overlapping parts increase the overall stiffness of the side wall of the shell 4 so that radiation of noises from the side walls can be minimized. As the two engagement fringes 26 and 36 are welded together after being press fitted into one another and without being interfered by the first and second separators 11 and 12, a favorable welding result can be achieved without requiring any special measures.

Figure 8:
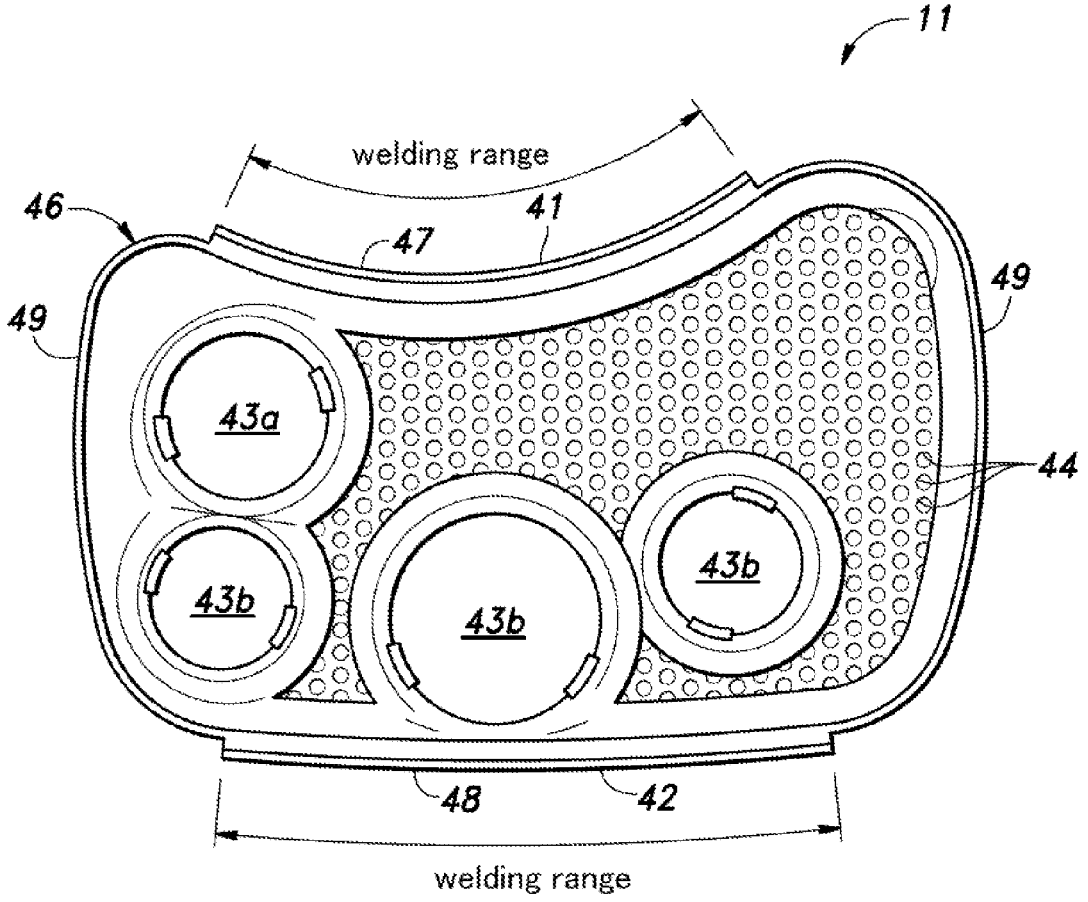
FIG. 8 is a rear view of a first separator.

As shown in FIG. 8, the first separator 11 is planar, and is substantially conformal to the first bonding portion 16 (or the inner contour thereof). Therefore, the first separator 11 is provided with an upper arcuate edge 41 defining a concave contour conforming to the second curved portion 25 of the first bonding portion 16 of the upper shell half 2, and a lower arcuate edge 42 defining a convex contour conformal to the second curved portion 35 of the first bonding portion 16 of the lower shell half 3. The first separator 11 is formed with four pipe holes 43 (43*a*, 43*b*) for receiving the inlet pipe 5 and the outlet pipe 7 (See FIG. 4), and is generally formed with a large number of small punching holes 44 except for the peripheral part thereof.

The outer periphery of the first separator 11 is formed with an axial flange 46 formed by bending the fringe of the steel plate at the time of stamping over the entire periphery thereof. The axial flange 46 includes an upper flange 47 formed along the upper arcuate edge 41 so as to oppose the second curved portion 25 of the upper shell half 2 at the first bonding portion 16 (FIG. 5), a lower flange 48 formed along the lower arcuate edge 42 so as to oppose the second curved portion 35 of the lower shell half 3 at the first bonding portion 16 (FIG. 5), and a pair of side flanges 49 extending in continuation with the upper flange 47 and the lower flange 48, and opposing the first curved portions 24 of the upper shell half 2, the side walls 23 and 33 of the two shell halves 2 and 3, and the first curved portions 34 of the lower shell half 3. The width (axial length) c of the upper flange 47 and the lower flange 48 is longer than the width (axial length) d of the side flanges 49. In the illustrated embodiment, the upper and lower flanges 47 and 48 and the side flanges 49 are directed in the same direction, but some of the flanges may be directed in the opposite direction without departing from the spirit of the present invention.

Figure 9:
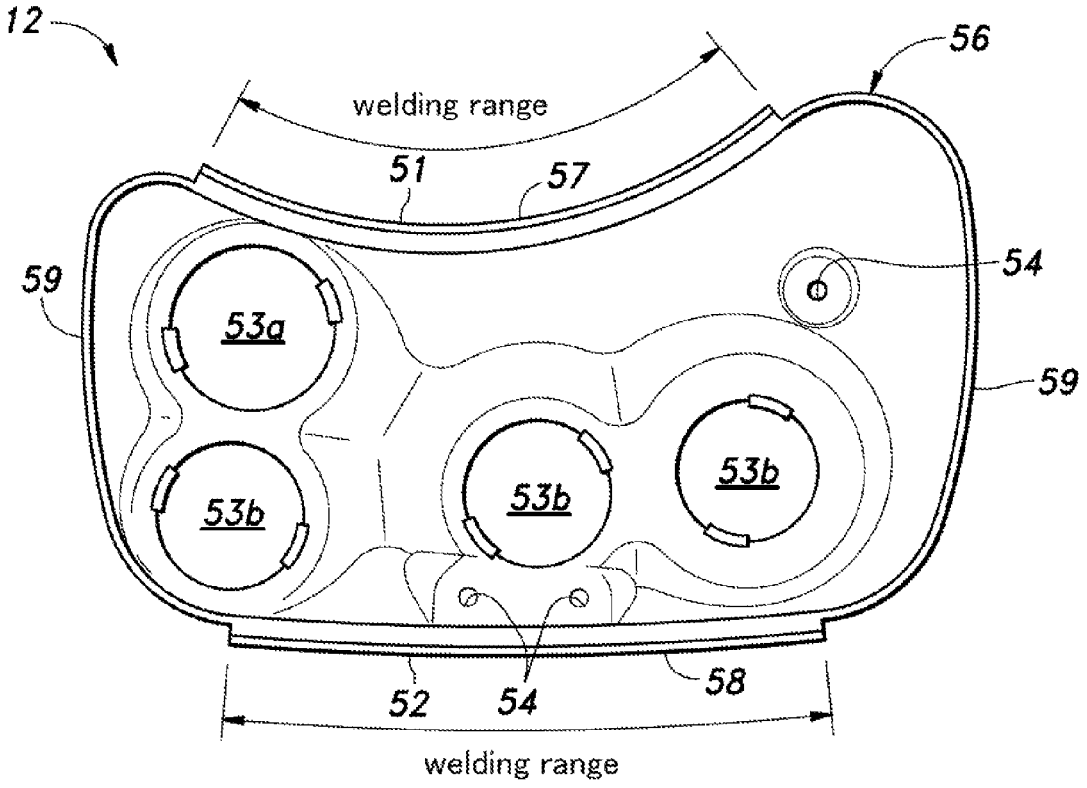
FIG. 9 is a rear view of a second separator.

As shown in FIG. 9, the second separator 12 is planar, and is substantially conformal to the second bonding portion 17 (or the inner contour thereof). Therefore, the second separator 12 is provided with an upper arcuate edge 51 defining a concave contour conforming to the second curved portion 25 of the second bonding portion 17 of the upper shell half 2, and a lower arcuate edge 52 defining a convex contour conformal to the second curved portion 35 of the second bonding portion 17 of the lower shell half 3. The second separator 12 is formed with four pipe holes 53 (53*a*, 53*b*) for receiving the inlet pipe 5, the outlet pipe 7 and the tail pipe 7 (See FIG. 4), and is formed with three acoustic interference holes 54, two in the lower part and one in the upper part.

The outer periphery of the second separator 12 is formed with an axial flange 56 formed by bending the fringe of the steel plate at the time of stamping over the entire periphery thereof. The axial flange 56 includes an upper flange 57 formed along the upper arcuate edge 51 so as to oppose the second curved portion 25 of the upper shell half 2 at the first second portion 17 (FIG. 6), a lower flange 58 formed along the lower arcuate edge 52 so as to oppose the second curved portion 35 of the lower shell half 3 at the second bonding portion 17 (FIG. 6), and a pair of side flanges 59 extending in continuation with the upper flange 57 and the lower flange 58, and opposing the first curved portions 34 of the upper shell half 2, the side walls 23 and 33 of the two shell halves 2 and 3, and the first curved portions 34 of the lower shell half 3. The width (axial length) c of the upper flange 57 and the lower flange 58 is longer than the width (axial length) d of the side flanges 59. In the illustrated embodiment, the upper and lower flanges 57 and 58 and the side flanges 59 are directed in the same direction, but some of the flanges may be directed in the opposite direction without departing from the spirit of the present invention.

As shown in FIG. 8, the first separator 11 is welded to the bottom walls 21 and 31 of the two shell halves 2 and 3 only at the upper flange 47 and the lower flange 48 having a single radius of curvature over the entire peripheral lengths thereof. As shown in FIG. 9, the second separator 12 is welded to the bottom walls 21 and 31 of the two shell halves 2 and 3 only at the upper flange 57 and the lower flange 58 having a single radius of curvature over the entire peripheral lengths thereof.

Figure 10:
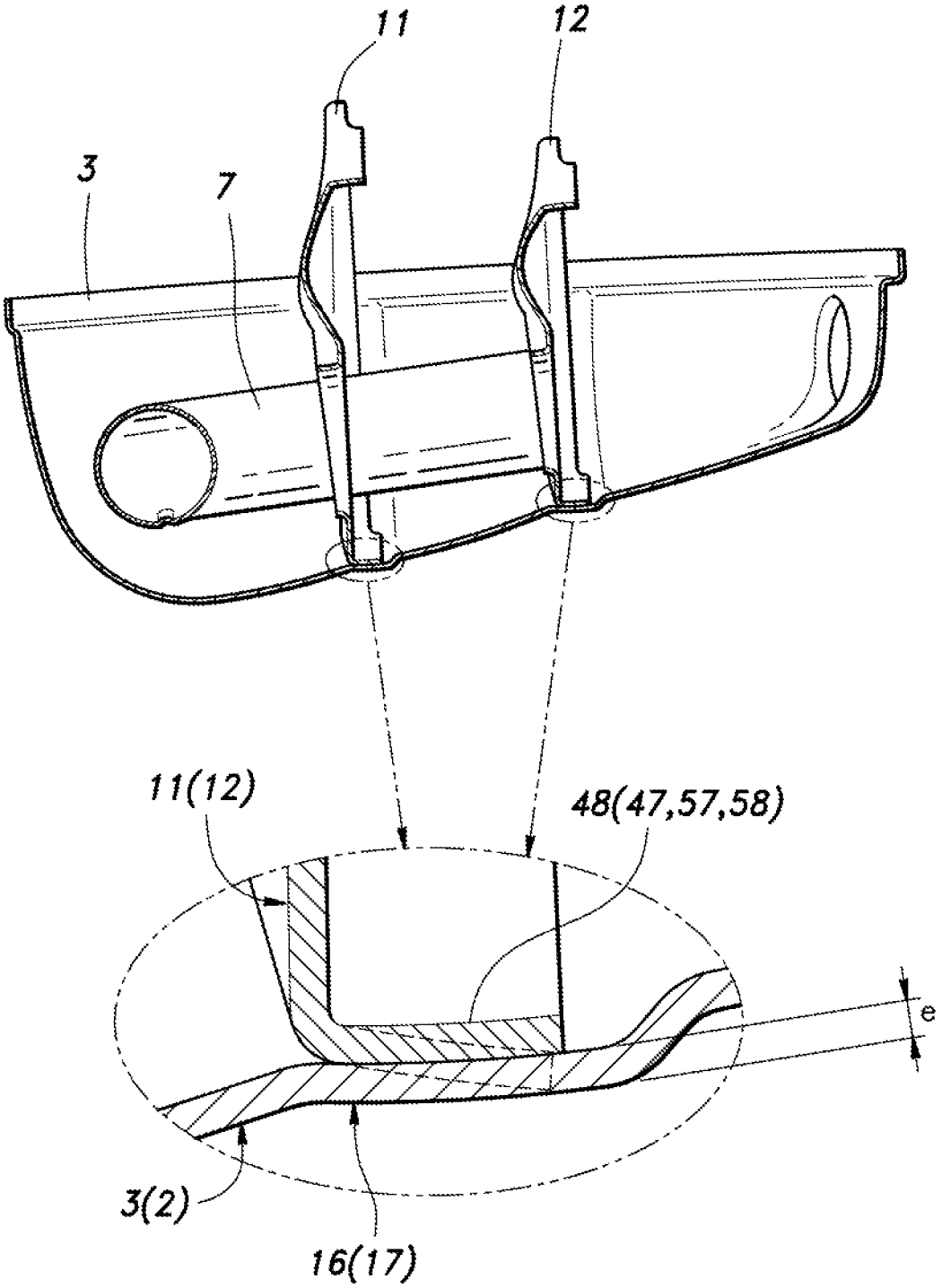
FIG. 10 is a sectional view taken along line X-X of FIG. 4.

The upper flanges 47 and 57 and the lower flanges 48 and 58 of the two separators 11 and 12 are initially bent by an angle slightly smaller than 90 degrees with respect to the major plane of the corresponding separators 11 and 12 before being assembled to the shell 4. As a result, when each separator 11, 12 is placed in the shell 4, the upper and lower flanges interfere with the inner surface of the corresponding bonding portion 16, 17. Therefore, in the assembling process, these flanges 47, 48, 57 and 58 are forcibly bent against the resilient force of the material of these flanges 47, 48, 57 and 58 (possibly causing some plastic deformation to them) so as to be fitted into the annular recess defined by the corresponding bonding portions 16 and 17 as shown in FIG. 10. Once the separators 11 and 12 are installed in this fashion, each of these flanges 47, 48, 57 and 58 is bent by about 90 degrees with respect to the major plane of the corresponding separator 11, 12, and establishes a surface contact with the flat bottom surface of the corresponding bonding portion 16, 17. At this time, the outer edges of the first and second separators 11 and 12 are substantially conformal to the inner contour of the corresponding bonding portions 16 and 17, and create a minimum amount of clearance with respect to the opposing inner surfaces of the bonding portions 16 and 17.

In the illustrated embodiment, the upper and lower flanges 47, 48, 57 and 58 are stamp formed in such a configuration that the tip of each flange is required to be bent by a prescribed amount e (such as 1.5 mm) for the flange to be fitted into and extend in parallel with the inner surface of the corresponding bonding portion 16, 17.

The upper and lower flanges 47, 48, 57 and 58 are then welded to the shell halves 2 and 3 at a laterally middle part of the flange in each case. Because the upper and lower flanges 47, 48, 57 and 58 are welded while being resiliently urged against the surfaces of the corresponding bonding portions 16 and 17, a favorable welding result can be achieved. Because the upper and lower flanges 47, 48, 57 and 58 are defined by arcs of a same radius of curvature, the two shell halves 2 and 3 can be stamp formed at a high precision, and the upper and lower flanges 47, 48, 57 and 58 can be uniformly deformed when installing the separators 11 and 12 in the shell 4 so that the separators 11 and 12 can be fitted in the shell 4 with a minimum amount of gap along the edges thereof and without causing any undue localized stress.

On the other hand, the side flanges 49 and 59 of the two separators 11 and 12 are stamp formed in such a configuration that the side flanges 49 and 59 extend in parallel with the inner surfaces of the first and second bonding portions 16 and 17 without interfering with any part of the shell 4 when the separators 11 and 12 are installed in the shell 4. This is advantageous because the side flanges 49 and 59 and the first curved portions 24 and 34 are so highly complex in shape that a great expense and a great difficulty are required to closely fit these parts to the opposing inner walls of the bonding portions 16 and 17. In cooperation with the upper and lower flanges 47, 48, 57 and 58, the side flanges 49 and 59 extend substantially entirely along the outer peripheries of the separators 11 and 12 so that a high stiffness can be ensured to the separators 11 and 12 without increasing the thickness thereof.

Referring to FIGS. 4 and 9, the lower two of the interference holes 54 of the second separator 12 provide the function to pass the moisture that may condense in the resonance chamber 15 to the second expansion chamber 14. The moisture introduced into the second expansion chamber 14 is further passed onto the first expansion chamber via the punching holes 33 of the first separator 11. In the illustrated embodiment, owing to the numerous punching holes 44 formed in the first separator 11, the first and second expansion chambers 13 and 14 function as a large single expansion chamber.

As shown in FIG. 4, the inlet pipe 5 is passed into the shell 4 through a left front end part of the side wall 33 of the lower shell half 3, and through the first and second separators 11 and 12. The downstream end of the inlet pipe 5 terminates in the resonance chamber. The part of the inlet pipe 5 passed through the side wall 33 is welded thereto around the entire circumference. Inside the shell 4, the inlet pipe 5 is fitted into a pipe opening 43*a*, 53*a* of each separator 11, 12 that is located higher than the remaining pipe holes 43*b*, 53*b* as shown in FIGS. 8 and 9.

The inlet pipe 5 is formed with a plurality of interference holes 61 in the part thereof located inside the first expansion chamber 13, a plurality of exhaust gas exit holes 62 in the part thereof located inside the second expansion chamber 14 and an exhaust gas exit hole 63 at the downstream end thereof located in the resonance chamber 15. In the illustrated embodiment, because the second separator 12 is formed with a relatively few small interference holes 54 (defining a relatively small opening area as a whole) while the first separator 11 is formed with numerous punching holes 44 (defining a relatively large opening area as a whole), and the exhaust gas within the muffler 1 is essentially expelled from the first expansion chamber 13 (as will be described hereinafter), even though the exhaust gas exit hole 63 defines a relatively large opening area, a majority of the exhaust gas introduced from the upstream end of the inlet pipe 5 flows into the second expansion chamber 14.

The outlet pipe 7 is retained by the first and second separators 11 and 12 inside the shell 4. The outlet pipe 7 includes an upstream end 7*a* communicating with the first expansion chamber 13, an intermediate part extending from the upstream end 7*a* in a rearward direction through the first and second separators 11 and 12 and making a U turn therefrom (from the resonance chamber 15) again through the second and first separators 11 and 12 into the first expansion chamber 13, and a downstream part extending once again from the first expansion chamber 13 to the resonance chamber 15 through the first and second separators 11 and 12. The terminal (rear end) 7*c* of the downstream part is located in the resonance chamber 15, and is connected to the upstream end of the tail pipe 6 which is passed into the resonance chamber 15 through the side wall 33 of the lower shell half 3. The outlet pipe 7 is located in a relatively low part of the shell 4, and is passed through the pipe holes 43*b* and 53*b* which are formed in relatively low parts of the corresponding separators 11 and 12 as shown in FIGS. 8 and 9.

The tail pipe 6 connected to the rear end or downstream end of the outlet pipe 7 is passed through the right rear end of the side wall 33 of the lower shell half 3, and extends rearward from the rear end of the shell 4. The tail pipe 6 is welded to the side wall 33 around the entire circumference thereof.

Figure 11:
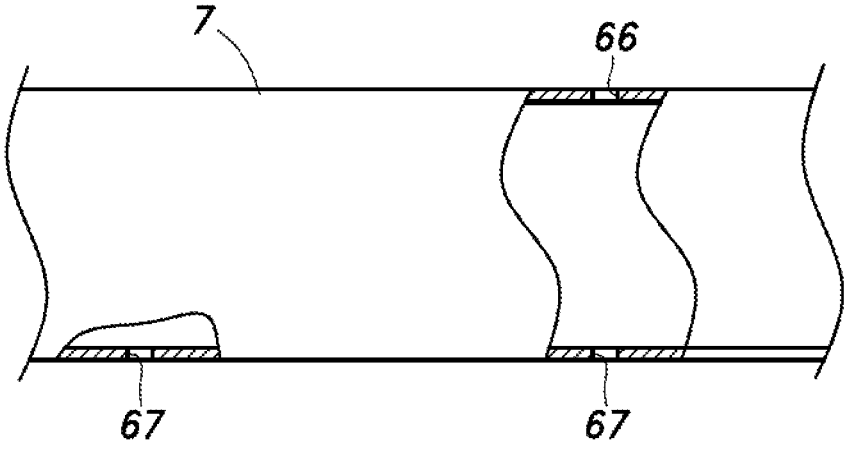
FIG. 11 is a partly broken away side view of a part of an outlet pipe as seen in the direction indicated by an arrow XI in FIG. 4.

The outlet pipe 7 is formed with a plurality of acoustic interference holes (not shown in the drawings) opening out from the lower side of the inlet pipe 5 toward the second expansion chamber 14 and a single acoustic interference hole 66 opening from the upper side of the inlet pipe 5 toward the first expansion chamber 13. As shown in FIG. 11, a pair of drain holes 67 are formed in the lower side of the outlet pipe 7 located in the first expansion chamber 13 to draw the water condensate that may accumulate in the lower shell half 3 and expel it to the outside via the tail pipe 6.

As discussed above, the height of the side wall 33 of the lower shell half 3 is substantially greater than the height of the side wall 23 of the upper shell half 2. As a result, for the given thickness of the steel plate material of these shell halves 2 and 3, the side wall 33 of the lower shell half 3 may be more prone to plane vibrations. In the illustrated embodiment, the fact that the inlet pipe 5 and the outlet pipe 7 (the tail pipe 6) contributes to the increase in the stiffness of the side wall of the lower shell half 3, and the lower shell half is no more prone to plane vibrations than the upper shell half. Thus, an favorable overall balance of stiffness between the upper and lower shell halves 2 and 3 is achieved owing to the difference between the heights of the side walls 23 and 33 of the lower and upper shell halves 2 and 3, and the presence of the inlet and outlet pipes 5 and 7 that are connected to the lower shell half 3.

When the engine of the motorcar carrying this muffler 1 is started, the exhaust gas expelled from the cylinders of the engine passes through the exhaust manifold, the catalyst device and the exhaust pipe, and is introduced into the shell 4 via the inlet pipe 5. The exhaust gas introduced from the inlet pipe 5 flows into the resonance chamber 15 via the interference holes 61, and then into the second expansion chamber 14 and the resonance chamber 15 via the exhaust gas exit holes 62 and 63. At this time, only a small part of the exhaust gas flows from the resonance chamber 15 to the second expansion chamber 14, and a large part of the exhaust gas is introduced into the first and second expansion chambers 13 and 14 owing to the provision of a large number of punching holes 44 in the first separator 11. At this time, the resonance chamber 15 attenuates exhaust noises of a prescribed frequency owing to the resonance action thereof.

The exhaust gas introduced into the first expansion chamber 13 flows into the outlet pipe 7 from the upstream end 7*a* thereof, and travels through the second expansion chamber 14, the resonance chamber 15 and the first expansion chamber 13 along the serpentine path of the outlet pipe 7 before being expelled from the muffler 1 via the tail pipe 6.

Engine exhaust gas normally contains a large amount of moisture which is condensed in the shell 4. In the illustrated embodiment, owing to the slant provided in the bottom wall 31 of the lower shell half 3, the moisture that has condensed in the resonance chamber 15 flows into the second expansion chamber 14 via the lower interference holes 54, and along with the moisture that has condensed in the second expansion chamber 14, flows into the first expansion chamber 13 via the punching holes 44 of the first separator 11. The condensed moisture in the first expansion chamber 13 is drawn into the outlet pipe 7 via the suction hole 67 thereof and expelled out of the shell 4 via the tail pipe 6 as discussed above.

The process of manufacturing the muffler 1 is described in the following with reference to FIG. 4 and FIGS. 12 to 14.

Figure 12:
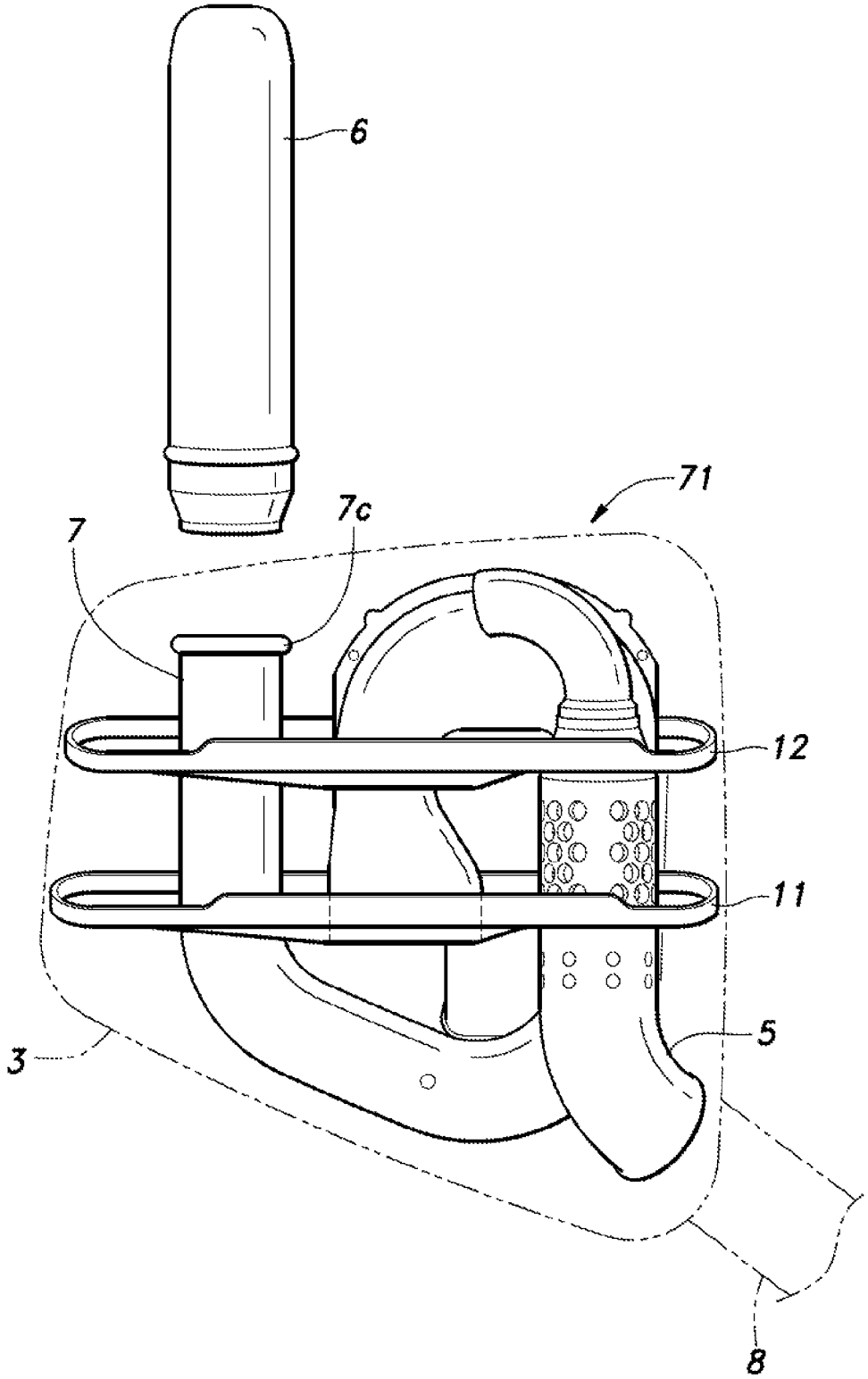
FIG. 12 is a plan view of the muffler showing an early assembling stage.

First of all, as shown in FIG. 12, the inlet pipe 5 and the outlet pipe 7 (without the tail pipe 6) are fitted into the first and second separators 11 and 12 to form such a subassembly 71.

Figure 13:
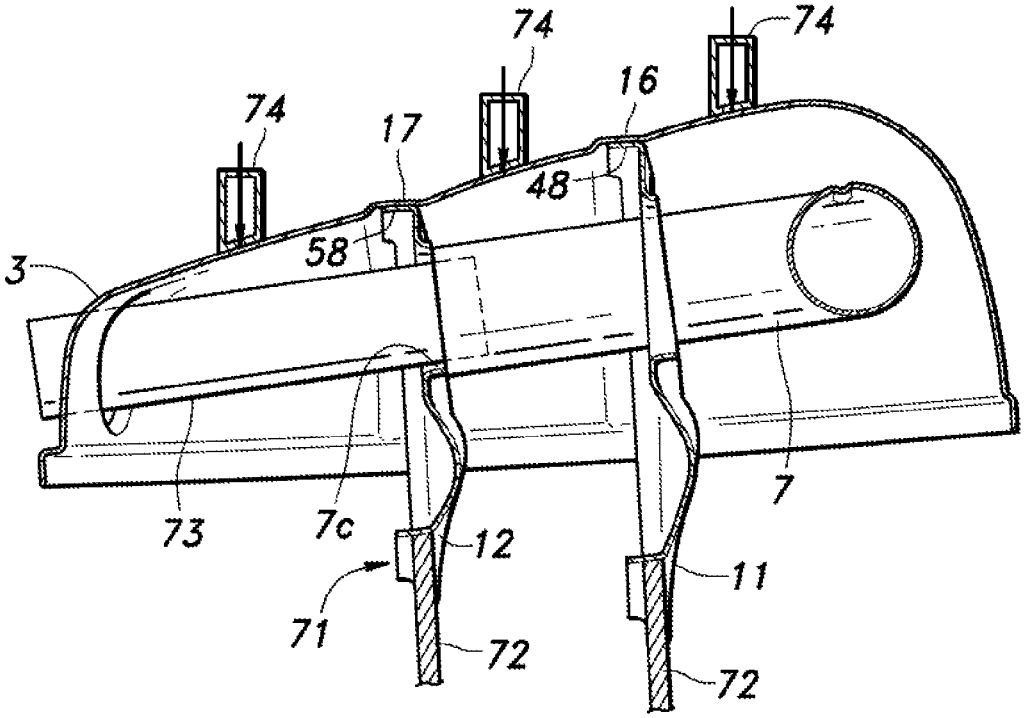
FIG. 13 is a sectional view of the muffler showing an intermediate assembling stage.
Figure 14:
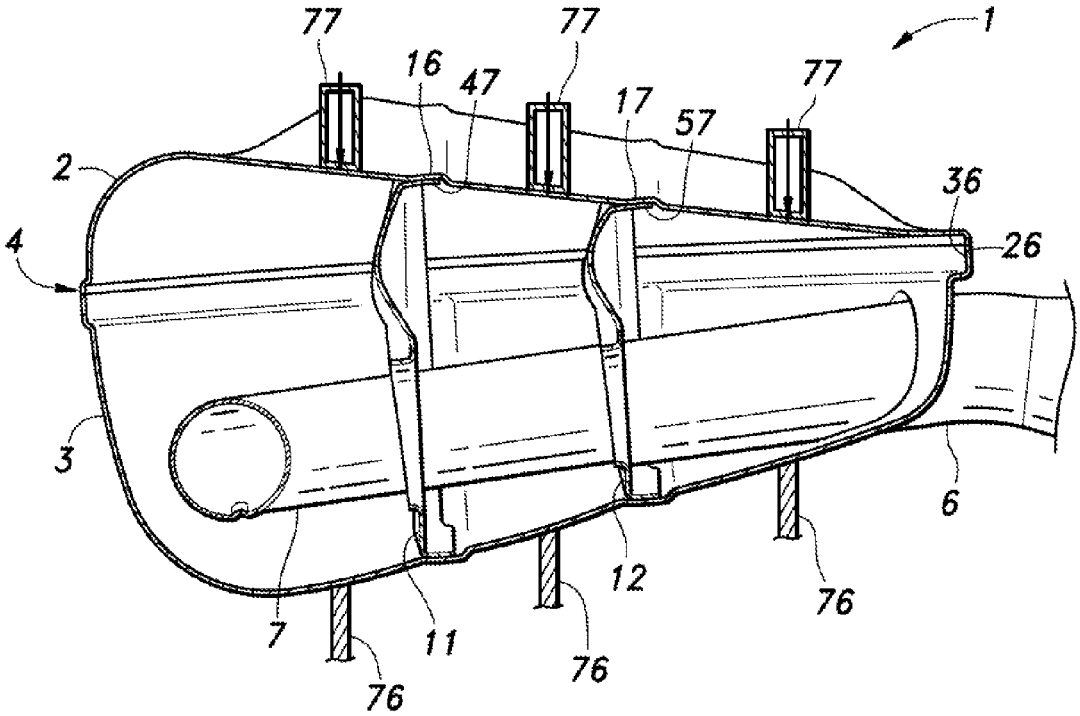
FIG. 14 is a sectional view of the muffler showing a late assembling stage.

Then, as shown in FIG. 13, this subassembly 71 is inverted, and placed on a support base 72 so as to be supported by the first and second separators 11 and 12. Then, the inlet pipe 5 is fitted into the side wall 33 of the lower shell half 2 with the opening 32 of the lower shell half 3 facing downward. At this stage, only the tips of the lower flanges 48 and 58 of the first and second separators 11 and 12 engage the inner surfaces of the first and second bonding portions 16 and 17 of the lower shell half 3. To facilitate the subsequent assembly work for the tail pipe 6, a positioning jig 73 is fitted into the outlet pipe 7 to fixedly place the position of the connection portion 7*c* of the outlet pipe 7 for the tail pipe 6. Thereafter, by using three jigs 74 placed between the bonding portions 16 and 17, and outwardly of the bonding portions 16 and 17 with respect to the fore and aft direction, a downward force is applied to the lower wall 31 of the lower shell half 3. This force is transmitted to the first and second separators 11 and 12 so that the lower flanges 48 and 58 are deflected into close contact with the inner surfaces of the first and second separators 11 and 12, respectively.

The lower flanges 48 and 58 are thus deflected so as to be parallel with the inner surfaces of the first and second bonding portions 16 and 17 and come into close contact with the inner surfaces over the entire lengths of the lower flanges 48 and 58. While this state is maintained, from the exterior of (above) the lower shell half 3, a laser beam is applied to a laterally central region of each of the first and second bonding portions 16 and 17 (the laterally central region of each of the lower flanges 48 and 58) over the entire circumference of the second curved portion 35 of the lower shell half 3 with the result that the lower flanges 48 and 58 of the first and second separators 11 and 12 are welded to the bottom wall 31 of the lower shell half 3 over the entire lengths thereof. Thereafter, the poisoning jigs 73 are removed, and the tail pipe 6 (FIG. 12) is fitted into the lower shell half 3 and then into the connecting portion 7*c* of the outlet pipe 7 from the rear, and is welded to the connecting portion 7*c* of the outlet pipe 7.

Then, as shown in FIG. 13, the muffler 1 which is being assembled is flipped over, and is placed on another support base 76. This support base 76 supports the bottom wall 31 of the lower shell half 3 at three positions, between the first and second bonding portions 16 and 17, and outwardly of the bonding portions 16 and 17 with respect to the fore and aft direction, which correspond to the positions of jigs 77 which will be discussed hereinafter. The upper shell half 2 is placed on the lower shell half 3 with the opening 22 thereof facing downward. Then, by using three jigs 77 placed between the first and second bonding portions 16 and 17, and outwardly of the bonding portions 16 and 17 with respect to the fore and aft direction, a downward pressure is applied to the bottom wall 31 of the lower shell half 3, causing the upper shell half 2 to be pressed against the first and second separators 11 and 12.

The annular engagement fringe 36 of the lower shell half 3 is fitted into the annular engagement fringe 26 of the upper shell half 2 so that the two annular engagement fringes 26 and 36 overlap with each other. At the same time, the upper flanges 47 and 57 are deflected such that the upper flanges 47 and 57 are brought into close contact with the inner surfaces of the first and second bonding portions 16 and 17. While this state is maintained, a laser beam is directed to the laterally central region of each of the first and second bonding portions 16 and 17 (corresponding to the laterally central region of each of the upper flanges 47 and 57) from outside (above) with the result that the upper flanges 47 and 57 of the first and second separators 11 and 12 are welded to the bottom wall 31 of the lower shell half 3 over the entire lengths thereof.

The muffler 1 being assembled is removed from the support base 76, and a laser beam is applied to the engagement fringe 26 of the upper shell half 2 from the exterior of the shell 4 over the entire circumference thereof with the result that the engagement fringe 26 of the upper shell half 2 is welded to the engagement fringe 36 of the lower shell half 3. The exhaust pipe 8 is connected to the inlet pipe 5. Then, the inlet pipe 5 (or the exhaust pipe 8) is welled to the side wall 33 of the lower shell half 3, and the tail pipe 6 is welded to the side wall 33 of the lower shell half 3, over the entire circumference of each pipe. This concludes the manufacturing process of the muffler 1.

In the muffler 1, the intermittent flow of high pressure exhaust gas into the inner chamber of the shell 4 inevitably causes the wall of the shell 4 to vibrate. In the illustrated embodiment, the first and second separators 11 and 12 are welded to the bottom walls 21 and 31 of the two shell halves 2 and 3. Therefore, the bottom walls 21 and 31 of the two shell halves 2 and 3 accounting for a large surface area of the shell 4 are reinforced by the separators 11 and 12, and are given with a high plane stiffness so that the emission of noises owing to wall vibrations can be minimized. The bottom walls 21 and 31 of the two shell halves 2 and 3 are defined by the concave (as seen from outside) second curved portion 25 and the convex (as seen from outside) second curved portion 35, respectively, and this also contributes to the increase in the plane stiffness of the bottom walls 21 and 31.

As for the side walls 23 and 33 of the two shell halves 2 and 3, the upper shell half 2 is given with a relatively small depth a so that the upper shell half 2 is given with a high plane stiffness and acoustic radiation from the upper shell half 2 can be minimized.

The lower shell half 3 is given with a relatively large depth b, and the side wall 33 thereof is therefore taller than that of the upper shell half 2, but the inlet pipe 5 and the outlet pipe 7 welded thereto increase the effective stiffness of the lower shell half 3 so that acoustic radiation from the lower shell half 3 can be controlled to be no more than that of the upper shell half 2.

In the illustrated embodiment, both the inlet pipe 5 and the outlet pipe 7 are connected to the lower shell half 3 so that the outlet pipe 7 is allowed to be placed near the bottom of the shell 4 (near the bottom wall 31 of the lower shell half 3), and this facilitates the expulsion of the condensed moisture from the shell 4 via the outlet pipe 7. Therefore, the fact that the outlet pipe 7 is connected to the side wall 33 of the lower shell half 3 not only contributes to the reduction of acoustic radiation from the lower shell half 3 but also to the facilitation of the expulsion of condensed moisture from the shell 4.

The openings 22 and 32 of the two shell halves 2 and 3 are defined by the annular engagement fringes 26 and 36 provided at the free end of the respective side walls 23 and 33, and the two engagement fringes 26 and 36 are welded to each other in an overlapping relationship so that the two shell halves 2 and 3 can be welded to each other without requiring any protrusions from the shell 4 or increasing the size of the shell 4. At the same time, the overlapping part increases the effective thickness of this part of the shell 4, and contributes to the increase in the stiffness of the side wall of the shell 4 so that the acoustic radiation from the sidewall of the shell 4 can be minimized.

Although the present invention has been described in terms of a preferred embodiment thereof, it is obvious to a person skilled in the art that various alterations and modifications are possible without departing from the scope of the present invention which is set forth in the appended claims.

For instance, in the illustrated embodiment, two separators 11 and 12 were provided in the shell 4, but one or more than two separators may also be provided in the shell 4 without departing from the spirit of the present invention. Also, the specific configurations and arrangement of the shell halves 2 and 3, the inlet pipe 5 and the outlet pipe 7 discussed above are only exemplary, and can be modified and altered without departing from the spirit of the present invention.

The contents of the original Japanese patent applications on which the Paris Convention priority claim is made for the present application as well as the contents of the prior art references mentioned in this application are incorporated in this application by reference.

The invention claimed is:

1. A muffler to be mounted on a lower surface of a vehicle body of a motor vehicle, the muffler comprising:

a shell formed by joining a pair of shell halves each defining a vessel shape including a bottom wall and a side wall and defining an opening opposite to the bottom wall, the shell halves being joined to each other at the openings thereof;

a separator attached to the two shell halves and separating an inner chamber of the shell;

an inlet pipe for introducing exhaust gas into the shell; and an outlet pipe for expelling exhaust gas from inside the shell, wherein:

the second shell half is located below the first shell half in a state where the muffler is mounted on the lower surface of the vehicle body;

each of the bottom walls of the first and second shell halves includes a curved portion defined by a single arc of a predetermined radius of curvature, the radius of curvature of the curved portion of the bottom wall of the first shell half being smaller than the radius of curvature of the curved portion of the bottom wall of the second shell half;

an outer periphery of the separator includes an upper arcuate edge conforming to the curved portion of the bottom wall of the first shell half and a lower arcutate edge conforming to the curved portion of the bottom wall of the second shell half;

the separator is provided with an upper flange extending from the upper arcuate edge and welded to the first shell half and a lower flange extending from the lower arcuate edge and welded to the second shell half; and a depth of the second shell half as measured between the bottom wall and the opening is greater than a depth of the first shell half, and the inlet pipe and the outlet pipe are connected to the side wall of the second shell half.

2. The muffler according to claim 1, wherein the opening of each shell half is defined by an annular fringe extending along a free end of the side wall thereof, and the annular fringes of the two shell halves are welded to each other in an overlapping relationship.

3. The muffler according to claim 2, wherein one of the annular fringes is provided with a slightly smaller circumferential length than that of the other annular fringe so that the one annular fringe is press fitted into the other annular fringe and welded thereto in an overlapping relationship.

4. The muffler according to claim 2, wherein the two annular fringes are spaced from an opposing edge of the separator.

5. The muffler according to claim 1, wherein the upper flange and the lower flange of the separator extend substantially perpendicularly to a major plane of the separator from the upper arcutate edge and the lower arcutate edge thereof, respectively, and each flange is welded to an opposing wall of the corresponding shell half while being placed in a pre-stressed condition.

6. The muffler according to claim 1, wherein the upper flange and the lower flange of the separator extend substantially perpendicularly to a major plane of the separator from the upper arcutate edge and the lower arcutate edge thereof, respectively, and each flange is welded to an opposing wall of the corresponding shell half while being placed in close contact with the opposing wall of the corresponding shell half.

7. The muffler according to claim 5, wherein the opposing wall of each shell half is defined by a planar bottom wall of a narrow recess recessed as seen from inside the shell and extending along the corresponding edge of the separator.

8. The muffler according to claim 7, wherein the narrow recess extends along an entire length of the edge of the separator.

9. The muffler according to claim 5, wherein the shell is provided with a planar section which is engaged by each of the upper and lower flanges, and the upper flange and the lower flange are welded to the corresponding planar sections while being held in parallel with the corresponding planar sections.

10. The muffler according to claim 5, wherein each flange is initially bent by an angle slightly smaller than 90 degrees with respect to a major plane of the separator, and is forced to an angle of about 90 degrees with respect to the major plane of the separator and placed in a pre-stressed condition when the flange is welded to the opposing wall surface of the corresponding shell half.

11. The muffler according to claim 4, wherein the separator is provided with an arcuate edge in an upper part and a lower part thereof, and the upper and the lower flanges are formed along the upper and lower arcuate edges of the separator.

12. The muffler according to claim 5, wherein the separator is further provided with a pair of side flanges extending substantially perpendicularly to the major plane of the separator from lateral edges thereof, the upper and lower flanges being provided with a greater width than either of the side flanges.

13. The muffler according to claim 12, wherein each side flange is detached from an opposing wall of the corresponding shell half.

14. The muffler according to claim 1, wherein the curved portion of the bottom wall of the first shell half defines a downwardly concave curve and the curved portion of the bottom wall of the second half defines a downwardly convex curve.

15. A method for manufacturing a muffler to be mounted on a lower surface of a vehicle body of a motor vehicle, the method comprising the steps of:

preparing first and second shell halves, each defining a vessel shape including a bottom wall and a side wall and defining an opening opposite to the bottom wall wherein the second shell half is located below the first shell half in a state where the muffler is mounted on the lower surface of the vehicle body, and each of the bottom walls of the first and second shell halves includes a curved portion defined by a single arc of a predetermined radius of curvature, the radius of curvature of the curved portion of the bottom wall of the first shell half being smaller than the radius of curvature of the curved portion of the bottom wall of the second shell half;

installing a separator into one of the shell halves, an outer periphery of the separator including an upper arcutate edge conforming to the curved portion of the bottom wall of the first shell half and a lower arcutate edge conforming to the curved portion of the bottom wall of the second shell half;

connecting an inlet pipe for introducing exhaust gas into the muffler to the side wall of one of the shell halves;

connecting an outlet pipe for expelling exhaust gas from the muffler to the side wall of the other shell half; and joining the two shell halves to each other by welding the two halves at the openings thereof and thereby forming a substantially enclosed shell;

wherein the separator is provided with an upper flange extending from the upper arcutate edge and welded to the first shell half and a lower flange extending from the lower arcutate edge and welded to the second shell half.

16. The method for manufacturing a muffler according to claim 15, wherein the upper and lower flanges of the separator extend substantially perpendicularly to a major plane of the separator, and each flange is placed in a pre-stressed condition when the flange is welded to the opposing wall surface of the corresponding shell half.

* * * * *